US007683841B2

(12) United States Patent
Mitsui

(10) Patent No.: US 7,683,841 B2
(45) Date of Patent: Mar. 23, 2010

(54) ANTENNA DEVICE

(75) Inventor: Tsutomu Mitsui, Yokohama-si (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 343 days.

(21) Appl. No.: 11/737,870

(22) Filed: Apr. 20, 2007

(65) Prior Publication Data

US 2008/0012778 A1 Jan. 17, 2008

(30) Foreign Application Priority Data

Jul. 11, 2006 (JP) ..... 2006-190242
Nov. 20, 2006 (KR) ..... 10-2006-0114721

(51) Int. Cl.
*H01Q 1/24* (2006.01)

(52) U.S. Cl. ..... 343/702

(58) Field of Classification Search ..... 343/702, 343/767–768, 794–795, 872
See application file for complete search history.

(56) References Cited

U.S. PATENT DOCUMENTS

| | | | | |
|---|---|---|---|---|
| 5,245,349 | A * | 9/1993 | Harada | 343/700 MS |
| 5,592,185 | A * | 1/1997 | Itabashi et al. | 343/794 |
| 5,767,814 | A * | 6/1998 | Conroy et al. | 343/774 |
| 6,359,599 | B2 * | 3/2002 | Apostolos | 343/895 |
| 7,006,051 | B2 * | 2/2006 | El-Mahdawy et al. | 343/806 |
| 2002/0084949 | A1 * | 7/2002 | Skalina et al. | 343/891 |
| 2002/0135528 | A1 * | 9/2002 | Teillet et al. | 343/797 |
| 2005/0237258 | A1 * | 10/2005 | Abramov et al. | 343/834 |

* cited by examiner

*Primary Examiner*—Huedung Mancuso
(74) *Attorney, Agent, or Firm*—Sughrue Mion, PLLC

(57) ABSTRACT

An antenna device including a circuit board; a pair of first antenna elements disposed symmetrically to each other about both wide surfaces of the circuit board and a pair of second antenna elements disposed symmetrically to each other about the both wide surfaces of the circuit board; a feeding terminal installed on each of the first antenna elements and each of the second antenna elements; and; and a feeding controller which feeds power selectively to at least one of the first and second antenna elements.

24 Claims, 6 Drawing Sheets

ANTENNA DEVICE

CROSS-REFERENCE TO RELATED PATENT APPLICATIONS

This application claims priority from Japanese Patent Application No. 2006-190242, filed, on Jul. 11, 2006, in the Japan Patent Office, and Korean Patent Application No. 10-2006-0114721, filed, on Nov. 20, 2006, in the Korean Intellectual Property Office, the disclosures of which are incorporated herein in their entirety by reference.

BACKGROUND OF THE INVENTION

1. Field of the Invention

Apparatuses consistent with the present invention relate to an antenna device that can be used in a Multiple Input Multiple Output (MIMO) communication system.

2. Description of the Related Art

Multiple Input Multiple Output (MIMO) wireless communication systems have recently attracted attention. MIMO systems are required to enable mobile high-speed data services in wideband mobile communication systems. MIMO indicates an antenna system having a MIMO function. The antenna system can transmit information from each antenna to improve the amount and reliability of transmitted information.

A directivity of an antenna is required to be optimally controlled to increase communication capacity in an MIMO system. There has been suggested a method of disposing a plurality of micro-strip radiators on a dielectric and selecting a micro-strip radiator pointing in a desired direction from the disposed micro-strip radiators by a switch in order to change a directivity of an antenna. However, the directivity is required to be dynamically changed to increase communication capacity. Thus, a method of selecting one from a plurality of micro-strip radiators using a switch complicates the structure of an antenna. Also, if plural antennas are mounted, a distance among the antenna should be about 0.5 λ (wherein λ denotes a wavelength of a transmitted wave) to secure the directivity of each of the antennas. Thus, it is difficult for an antenna device to be compact.

Also, there has been disclosed a structure in which two patch antennas are disposed on both surfaces of a peripheral component (PC) card and one of the two patch antennas is selected to improve communication performance. In this case, the directivity is limited. Thus, the directivity cannot be secured in every possible direction. As a result, it is difficult to secure sufficient communication capacity over all directions in which communication is to be performed.

SUMMARY OF THE INVENTION

The present invention provides an antenna device having communication capacity which is increased by changing the directivity of an antenna using a simple structure.

According to exemplary embodiments of the present invention, there is provided an antenna device including a circuit board; a pair of first antenna elements disposed symmetrical to each other about both wide surfaces of the circuit board, and a pair of second antenna elements disposed symmetrical to each other about the both wide surfaces of the circuit board; feeding terminals installed on each of the first antenna element pair and the second antenna element pair; and a feeding controller which feeds power selectively to at least one of the first or second antenna elements.

BRIEF DESCRIPTION OF THE DRAWINGS

The above and other aspects of the present invention will become more apparent by describing in detail exemplary embodiments thereof with reference to the attached drawings, in which.

DETAILED DESCRIPTION OF EXEMPLARY EMBODIMENTS

Figure 1:
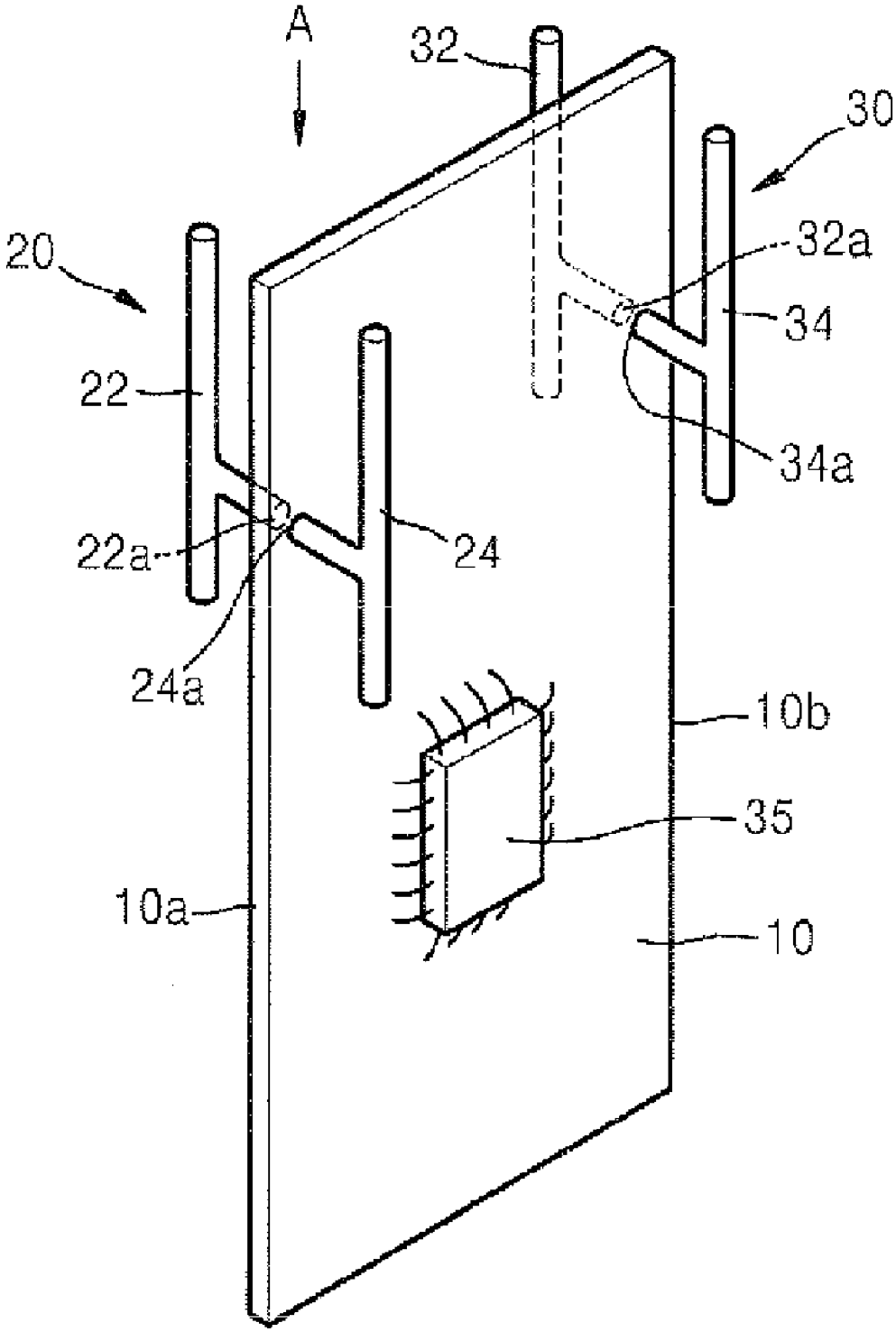
FIG. 1 is a perspective view of an antenna device according to an exemplary embodiment of the present invention.

Hereinafter, antennas according to exemplary embodiments of the present invention will be described in detail with reference to the attached drawings. Like reference numerals in the drawings denote like elements, and thus their description will be omitted.

FIG. 1 is a perspective view of an antenna device according to an exemplary embodiment of the present invention. Referring to FIG. 1, the antenna device includes a bar-shaped magnetic monopole antenna. The antenna device further includes a circuit board 10 and first and second antennas 20 and 30 installed on the circuit board 10.

For example, the antenna device according to the present exemplary embodiment may be mounted in a terminal of a portable telephone or the like, use the first and second antennas 20 and 30, and perform communications using a Multiple Input Multiple Output (MIMO) method.

The circuit board 10 is installed inside the terminal of the portable telephone or the like. The circuit board 10 has a single layer structure in the antenna device according to the present exemplary embodiment. Alternatively, the circuit board 10 may have a multilayer structure.

The first antenna 20 includes first antenna elements 22 and 24. The second antenna 30 includes second antenna elements 32 and 34. The first antenna elements 22 and 24 and the second antenna elements 32 and 34 may be formed of a metal material having a low resistance such as copper (Cu), gold (Au), or the like.

As shown in FIG. 1, the first antenna 20 is installed along an outer framework (or a side) 10*a* of one end of the circuit board 10, and the second antenna 30 is installed along an outer framework (or a side) 10*b* of the other end of the circuit board 10. The first antenna elements 22 and 24, and the second antenna elements 32 and 34 are installed inside each of the outer frameworks 10*a* and 10*b*, respectively. The first antenna elements 22 and 24 are oppositely disposed at a predetermined distance from the circuit board 10, so as to face each other with respect to the circuit board 10. The second antenna elements 32 and 34 are oppositely disposed at a predetermined distance from the circuit board 10, so as to face each other with respect to the circuit board 10.

The first antenna element 22 is supplied with power from the circuit board 10 through a feeder 22*a*. The feeder 22*a* is a part of the first antenna element 22 connected to the circuit board 10 and is positioned a predetermined distance apart from a center of the first antenna element 22 installed in a vertical direction. Here, if the first antenna element 22 is supplied with the power without the circuit board 10, the first antenna element 22 generates a vertical directivity pattern so as to radiate a wide directivity electromagnetic wave having an isotropic pattern.

The first antenna element 24 is supplied with power from the circuit board 10 through a feeder 24*a*. The feeder 24*a* is a part of the first antenna element 24 connected to the circuit board 10 and is positioned a predetermined distance apart from a center of the first antenna element 24 installed in a vertical direction. If the first antenna element 24 is supplied with the power without the circuit board 10, the first antenna element 24 generates a vertical directivity pattern so as to radiate a wide directivity electromagnetic wave having an isotropic pattern.

Like the first antenna 20 fed with the power from the feeders 22*a* and 24*a* connected to the circuit board 10, the second antenna 30 is fed with power from feeders 32*a* and 34*a* connected to the circuit board 10. Feeding of the first antenna elements 22 and 24 and the second antenna elements 32 and 34 is controlled by a feeding controller 35. For example, the feeding controller 35 may be a micro processor (chip) which is mounted on the circuit board 10 as shown in FIG. 1.

In the antenna device according to the present exemplary embodiment, the first antenna elements 22 and 24, the second antenna elements 32 and 34, and the feeders 22*a*, 24*a*, 32*a*, and 34*a* are disposed inside each of the outer frameworks 10*a* and 10*b* of the circuit board 10, respectively. However, the feeders 22*a*, 24*a*, 32*a*, and 34*a* may be disposed inside the outer frameworks 10*a* and 10*b* of the circuit board 10, respectively, while portions of the first antenna elements 22 and 24 and the second antenna elements 32 and 34 may be disposed outside the outer frameworks 10*a* and 10*b* of the circuit board 10, respectively.

The second antenna 30 has the same structure as the first antenna 20. Thus, only the first antenna 20 will be described below.

Also, the antenna device according to the present exemplary embodiment may be mounted in an antenna pattern selection (APS) system to improve communication capacity. In the APS system, directivity patterns of the first and second antennas 20 and 30 are controlled by the feeding controller 36 to produce an optimal communication environment.

Figure 2:
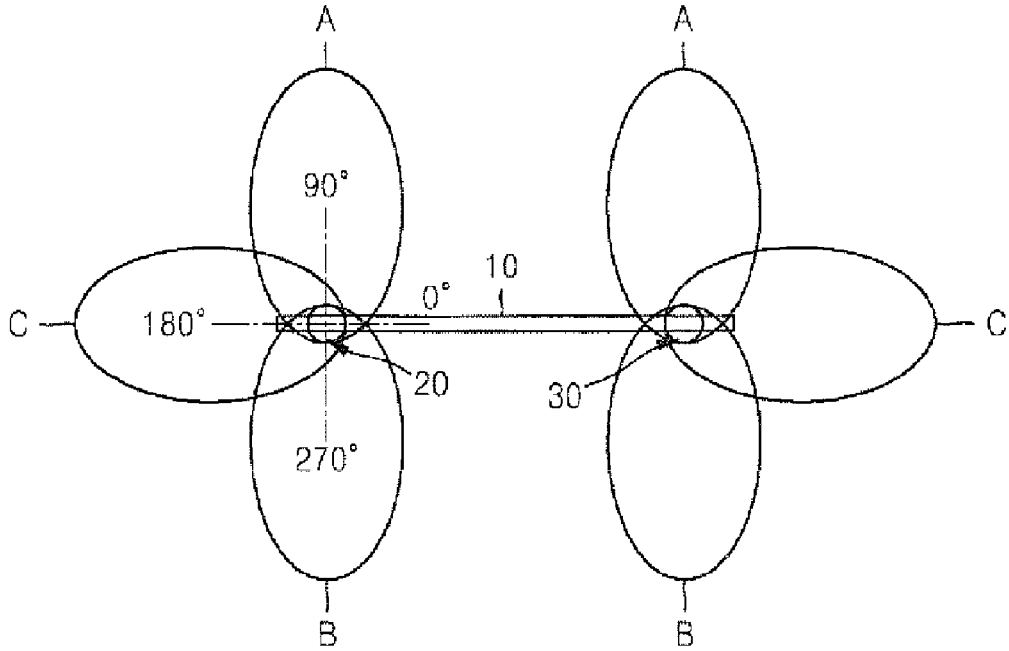
FIG. 2 is a schematic view illustrating directivities necessary for an antenna pattern selection (APS) system.

FIG. 2 is a schematic view illustrating directivities necessary for an antenna pattern selection (APS) system. For convenience, an area in which the center between the first antenna elements 22 and 24 is positioned is shown as the first antenna 20, and an area in which the center between the second antenna elements 32 and 34 is positioned is shown as the second antenna 30. As shown in FIG. 2, each of the first and second antennas 20 and 30 generates three beam patterns A, B, and C.

The beam patterns A, B, and C are selected according to a communication environment. For example, if a base station communicates with a portable terminal in which the circuit board 10 is mounted, a beam pattern facing the base station is selected from the three beam patterns. The selection of the directivity is independently performed in the first and second antennas 20 and 30.

In the antenna device according to the present exemplary embodiment, the first antenna elements 22 and 24 are disposed on both wide surfaces of the circuit board 10 to use the circuit board 10 as a reflector. Thus, the three beam patterns A, B, and C are generated from the first antenna elements 22 and 24. In general, predetermined metal wire patterns are installed on the circuit board 10. Thus, the wide surfaces of the circuit board 10 have an equivalent property to the material of the metal wire patterns with respect to a frequency of electromagnetic waves. As a result, electromagnetic waves radiated from the first antenna elements 22 and 24 are reflected from the wide surfaces of the circuit board 10. If the circuit board 10 is a multilayer board, the circuit board 10 is positioned to face the first antenna elements 22 and 24. If wire patterns are not disposed on an uppermost layer but disposed on the lowermost layer of the circuit board 10, electromagnetic waves may be reflected from the surface of the lowermost layer of the circuit board 10. Also, metal patterns, i.e., dummy patterns, may be installed on the surfaces of the circuit board 10 to reflect electromagnetic waves.

The directivity of an electromagnetic wave may be set such that there are four or more beam patterns with respect to an antenna. However, if each of the first and second antennas 20 and 30 has the three beam patterns A, B, and C, sufficient communication capacity may be secured with respect to all estimated communication environments.

In the antenna according to the present exemplary embodiment, the circuit board 10 is used as reflecting surfaces or a reflector for electromagnetic waves radiated from the first and second antennas 20 and 30 to narrow the directivity. Thus, the three beam patterns A, B, and C are generated as shown in FIG. 2. Here, the directivity C is formed through synthesis of the beam patterns A and B. A method of generating the beam patterns A, B, and C in the first antenna 20 will now be described in detail.

Figure 3:
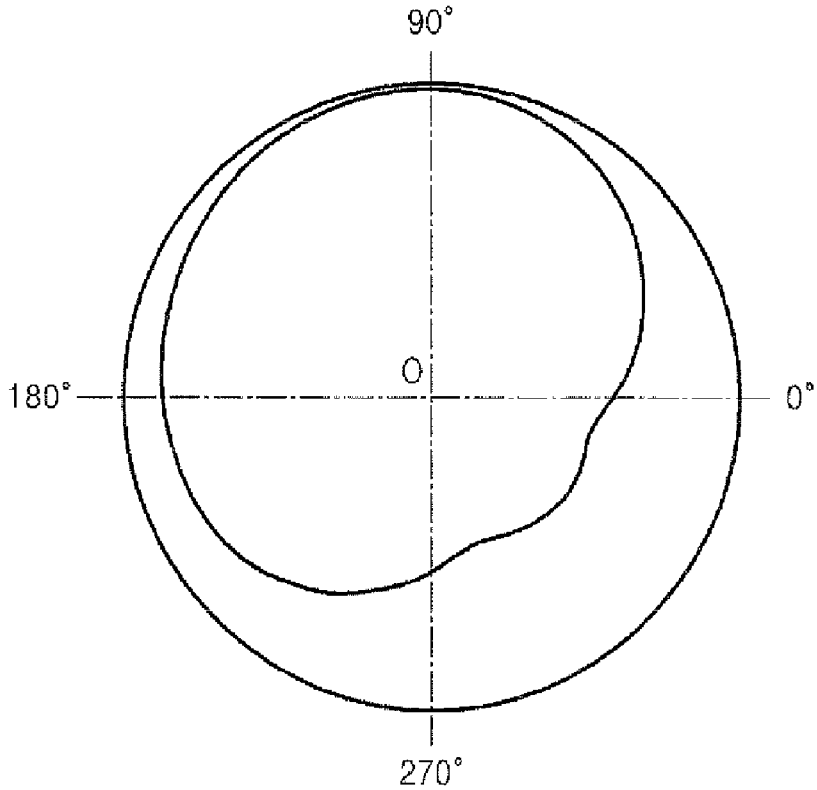
FIG. 3 is a schematic view illustrating results of a simulation performed on an intensity of an electrical field having a directivity A of FIG. 2.
Figure 4:
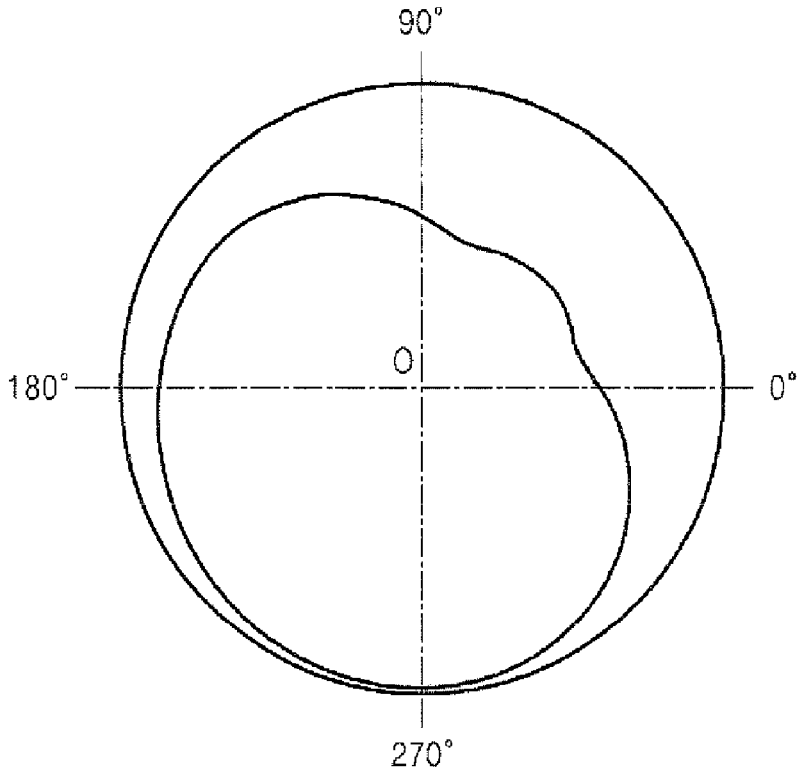
FIG. 4 is a schematic view illustrating results of a simulation performed on an intensity of an electrical field having a directivity B of FIG. 2.
Figure 5:
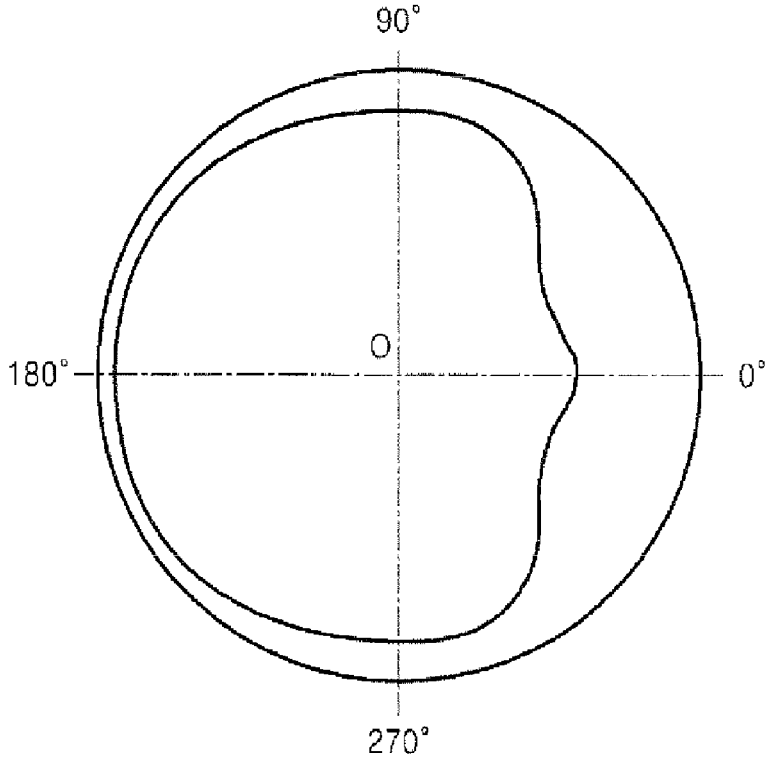
FIG. 5 is a schematic view illustrating results of a simulation performed on an intensity of an electrical field having a directivity C of FIG. 2.

FIGS. 3, 4, and 5 illustrate radiation patterns A, B, and C of an antenna illustrated in FIG. 2. Referring to FIGS. 3, 4, and 5, a central point O corresponds to a central point between the first antenna elements 22 and 24. Positions of angles 0°, 90°, 180°, and 270° correspond to positions of angles of FIG. 2. Also, the circuit board 10 is disposed on a straight line connecting the angles 0° and 180°. Also, an arrival range of an electromagnetic wave is schematically shown in FIGS. 3, 4, and 5. This arrival ranges are much wider than a distance between the first antenna elements 22 and 24. Thus, the first antenna elements 22 and 24 are not shown.

FIG. 3 is a schematic view illustrating a directivity when only the first antenna element 22 is fed with power, FIG. 4 is a schematic view illustrating a directivity when only the first antenna element 24 is fed with power, and FIG. 5 is a schematic view illustrating a directivity when the first antenna elements 22 and 24 are fed with power. Referring to FIGS. 3, 4, and 5, angles in a circumferential direction correspond to the angles of FIG. 2.

As shown in FIG. 3, if only the first antenna element 22 is fed with power, an electromagnetic wave radiated from the first antenna element 22 is reflected from the circuit board 10. The peak of the beam pattern is at 90°, i.e., perpendicular to the surface of the circuit board 10, to narrow a radiation width of the electromagnetic wave. Thus, a beam pattern having the shape of A of FIG. 2 may be formed.

If only the first antenna element 24 is fed with power as shown in FIG. 4, an electromagnetic wave radiated from the first antenna element 24 is reflected from the circuit board 10. A peak of the beam pattern is at 270°, i.e., perpendicular to the surface of the circuit board 10, to narrow a radiation width of the electromagnetic wave. Thus, a beam pattern having the shape of B of FIG. 2 may be formed.

Isotropic electromagnetic waves are radiated from the first antenna elements 22 and 24, and the directivities of the isotropic electromagnetic waves can be narrowed when the waves are reflected from the circuit board 10. Thus, according to the present exemplary embodiment, communication capacity can be improved compared to an antenna generating omni-directional beam patterns.

FIG. 5 is a schematic view illustrating directivities if the first and second antenna elements 22 and 24 are fed with power. If only one of the first antenna elements 22 and 24 is fed with power, a peak of the directivity is at 90° or 270°. Since the first antenna element 22 is disposed near a side 10*a* of the circuit board 10, the reflection of an electromagnetic wave radiated from the first antenna element 22 from the side 10*a* becomes weak. Thus, if only the first antenna element 22 is fed with power, the directivity A inclines from 90° toward 180° as shown in FIG. 3. Likewise, the first antenna element 24 is also disposed near the side 10*a* of the circuit board 10, the reflection of an electromagnetic wave radiated from the first antenna 24 from the side 10*a* becomes weak. Thus, if only the first antenna element 24 is fed with the power, the shape of B inclines from 270° toward 180° as shown in FIG. 4.

If the first antenna elements 22 and 24 are fed with the power to radiate electromagnetic waves having the same amplitude and phase, an electromagnetic wave having the shape of A inclining from 90° toward 180° is synthesized with an electromagnetic wave having the shape of B inclining from 270° toward 180°. Thus, a peak of the beam pattern is at 180°, i.e., toward the side 10*a* of the circuit board 10. As a result, both of the first and second antenna elements 22 and 24 may be fed with the power to form a beam pattern having the shape of C of FIG. 2. In addition, when the first and second antenna elements 22 and 24 are fed with the power, the power value is equal to a sum of a power value obtained when the power is fed to the first antenna elements 22 and 24, separately.

If patch antennas having very narrow directivities are used as the first antenna elements 22 and 24, the electromagnetic waves radiated from the first antenna elements 22 and 24 are not synthesized, and the shape of C is not radiated. In the antenna device according to the present exemplary embodiment, the beam patterns A and B may be synthesized with each other to radiate the shape of C so as to generate isotropic beam patterns from the first antenna elements 22 and 24. Also, the first antenna elements 22 and 24 are disposed in positions in which the circuit board 10 is used as a reflector. Thus, the beam patterns A and B may be narrowed. As a result, the shape of C may be narrowed. Therefore, communication capacity can be improved toward a transverse direction, i.e., the shape of C, so as to improve whole communication capacity of the antenna device.

According to an exemplary embodiment of the present invention, the first antenna element 22 or 24 may be selectively fed with the power. Thus, electromagnetic waves having the beam patterns A, B, and C shown in FIG. 2 may be radiated. The beam patterns A, B, or C may be optimally selected in a communication environment to stably perform communications with sufficient communication capacity.

Figure 6:
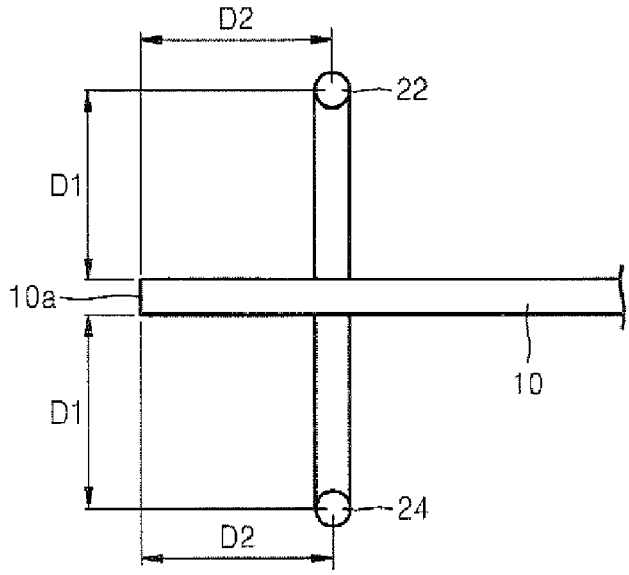
FIG. 6 is a schematic view illustrating a position relationship between a circuit board and two elements.

FIG. 6 is a schematic view illustrating a position relationship between the first antenna elements 22 and 24 and the circuit board 10. Here, the circuit board 10 and the first antenna elements 22 and 24 are viewed from direction A indicated by an arrow of FIG. 1. Referring to FIG. 6, a distance between each of the first antenna elements 22 and 24 and the circuit board 10 is D1, and a distance between the outer framework 10*a* of the circuit board 10 and each of the first antenna elements 22 and 24 is D2. When the distances D1 and D2 are each 0.087 λ (where λ denotes a wavelength of an electromagnetic wave), the results of the simulations of FIGS. 3 to 5 are obtained. If a frequency f of an electromagnetic wave is $5\times10^9$ [Hz], and light velocity c is $3\times10^8$ [m/s], $\lambda=c/f=(3\times10^8/5\times10^9)$, and 0.087 λ is about 5 mm.

Directivities as shown in FIGS. 3 to 5 may vary through variations of the distances D1 and D2. In particular, the beam patterns A and B may vary with a variation of the distance D2. Referring to FIGS. 3 to 4, electromagnetic waves having beam patterns A and B are made to incline toward 180° by reducing the distance D2. Thus, an electromagnetic wave having a beam pattern C obtained through synthesis of the beam patterns A and B is narrowed based on 180° through a reduction in the distance D2. If the distance D2 is greater than 0.15 λ, the inclinations of the beam patterns A and B toward 180° are reduced. Thus, the directivity C does not incline toward 180°. As a result, the distance D2 may be less than or equal to 0.15 λ.

The distance D1 is equal to 0.087 λ. Since the first antenna elements 22 and 24 are very close to the circuit board 10, the directivity may be narrowed due to reflection of an electromagnetic wave from the circuit board 10. Although the first antenna elements 22 and 24 are disposed more closely to the circuit board 10 than 0.087 λ, the directivity of an electromagnetic wave does not mostly vary. If the distance D1 is greater than or equal to 0.5 λ, the directivity of the electromagnetic wave may vary to weaken the reflection of the electromagnetic wave from the circuit board 10. Thus, as long as the distance D1 is not greater than 0.5 λ, an effect of the distance D1 on the beam patterns A and B caused by a slight variation of the distance D1 are small. As a result, an effect of the distance D1 on the directivity C is small.

Figure 7:
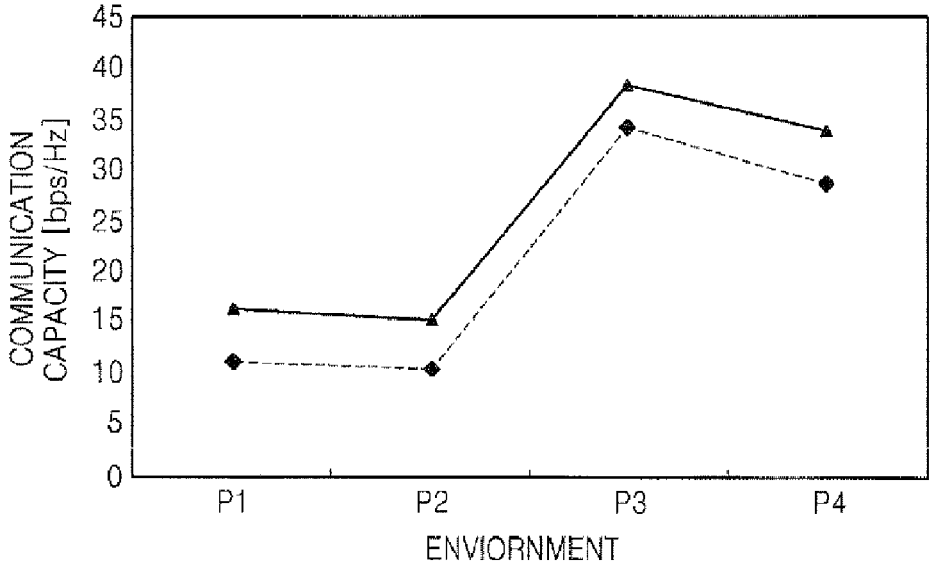
FIG. 7 is a graph illustrating an improvement in communication capacity provided by an antenna device according to an exemplary embodiment of the present invention.

FIG. 7 is a graph illustrating an improvement in communication capacity provided by an antenna device of the present invention. Here, a vertical axis denotes communication capacity [bps/Hz], and a horizontal axis denotes environments of four places P1, P2, P3, and P4 in which communications are performed. Referring to FIG. 7, a solid line denotes the communication capacity of the antenna device of an exemplary embodiment of the present invention. A broken line denotes communication capacity of a magnetic monopole antenna having an isotropic beam pattern. According to the antenna device of the present exemplary embodiment, the communication capacity can be improved with respect to the places P1, P2, P3, and P4 to narrow the directivity of an isotropic beam pattern through the reflection of an electromagnetic wave from the circuit board 10.

Figure 8:
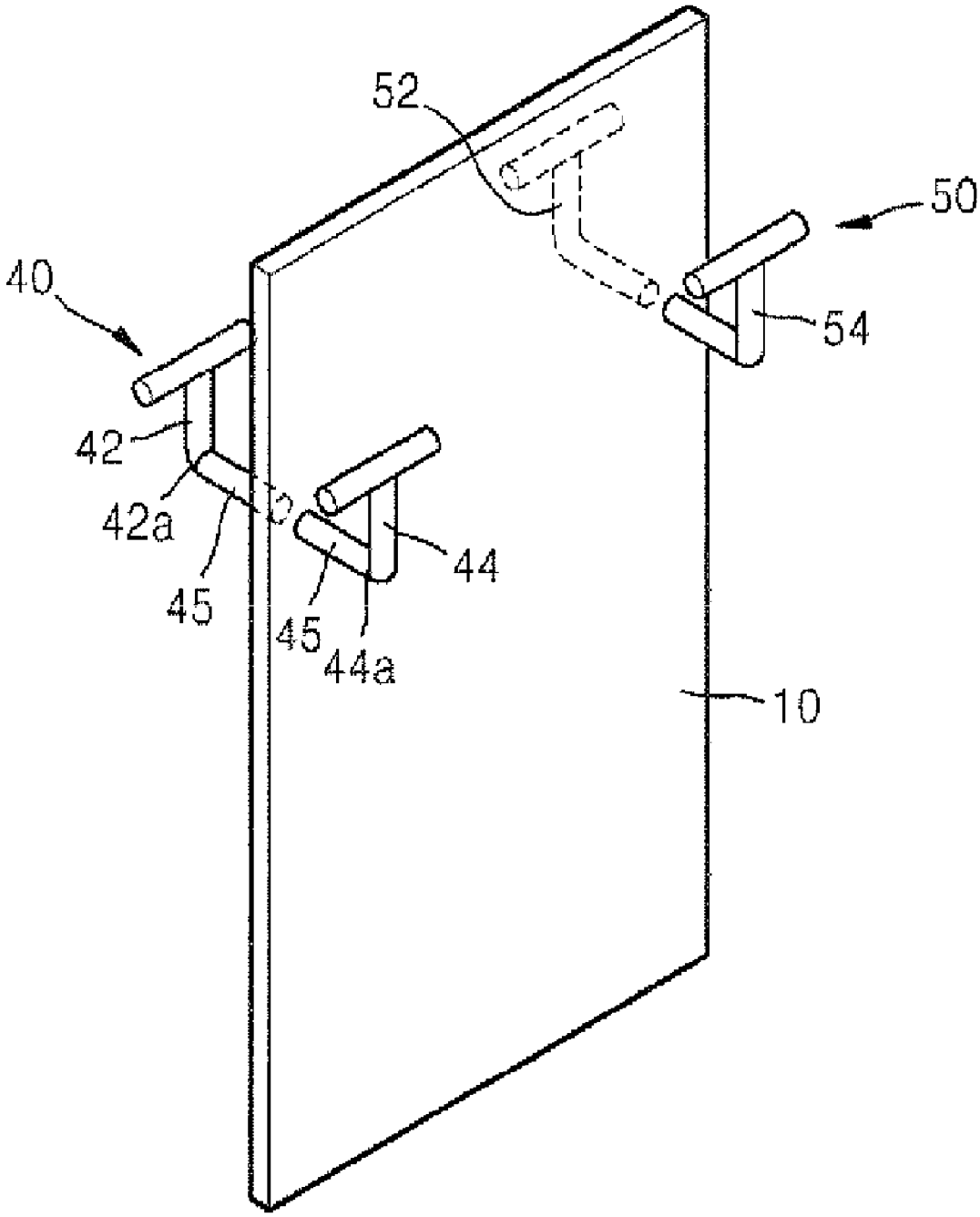
FIG. 8 is a perspective view of an antenna device according to another exemplary embodiment of the present invention.

FIG. 8 is a perspective view of an antenna device according to another exemplary embodiment of the present invention. Referring to FIG. 8, the antenna device includes T-shaped magnetic monopole antennas. A first T-shaped magnetic monopole antenna (hereinafter referred to as a T-shaped first antenna) 40 includes first T-shaped antenna elements 42 and 44. A second T-shaped magnetic monopole antenna (hereinafter referred to as a T-shaped second antenna) 50 includes second T-shaped antenna elements 52 and 54. The T-shaped second antenna 50 has substantially the same structure as the T-shaped first antenna 40, and thus the T-shaped first antenna 40 will be mainly described.

The first T-shaped antenna element 42 is fed with power from a circuit board 10 through a feeder 42*a*. If the T-shaped first antenna element 42 is fed with the power from the circuit board 10 through the feeder 42*a*, a vertical directivity pattern is generated in a vertical direction of the T-shaped first antenna element 42 to radiate an electric wave. The T-shaped first antenna element 44 is fed with power from the circuit board 10 through a feeder 44*a*. The feeders 42*a* and 44*a* are connected to the circuit board 10 through feeding lines 45. If the circuit board 100 feeds the power to the feeder 44*a*, a vertical directivity pattern is generated in a vertical direction of the T-shaped first antenna element 44 so as to radiate an electric wave.

Like the antenna device of FIG. 1 according to the previous exemplary embodiment, electromagnetic waves radiated from the T-shaped first antenna elements 42 and 44 are reflected from the circuit board 10. Thus, only the T-shaped first antenna element 42 may be fed with the power to generate a beam pattern having a shape of A. Alternatively, only the T-shaped first antenna element 44 may be fed with the power to generate a beam pattern having a shape of B. Both of the T-shaped first antenna elements 42 and 44 may be fed with the power to generate a beam pattern having a directivity of C.

Figure 9:
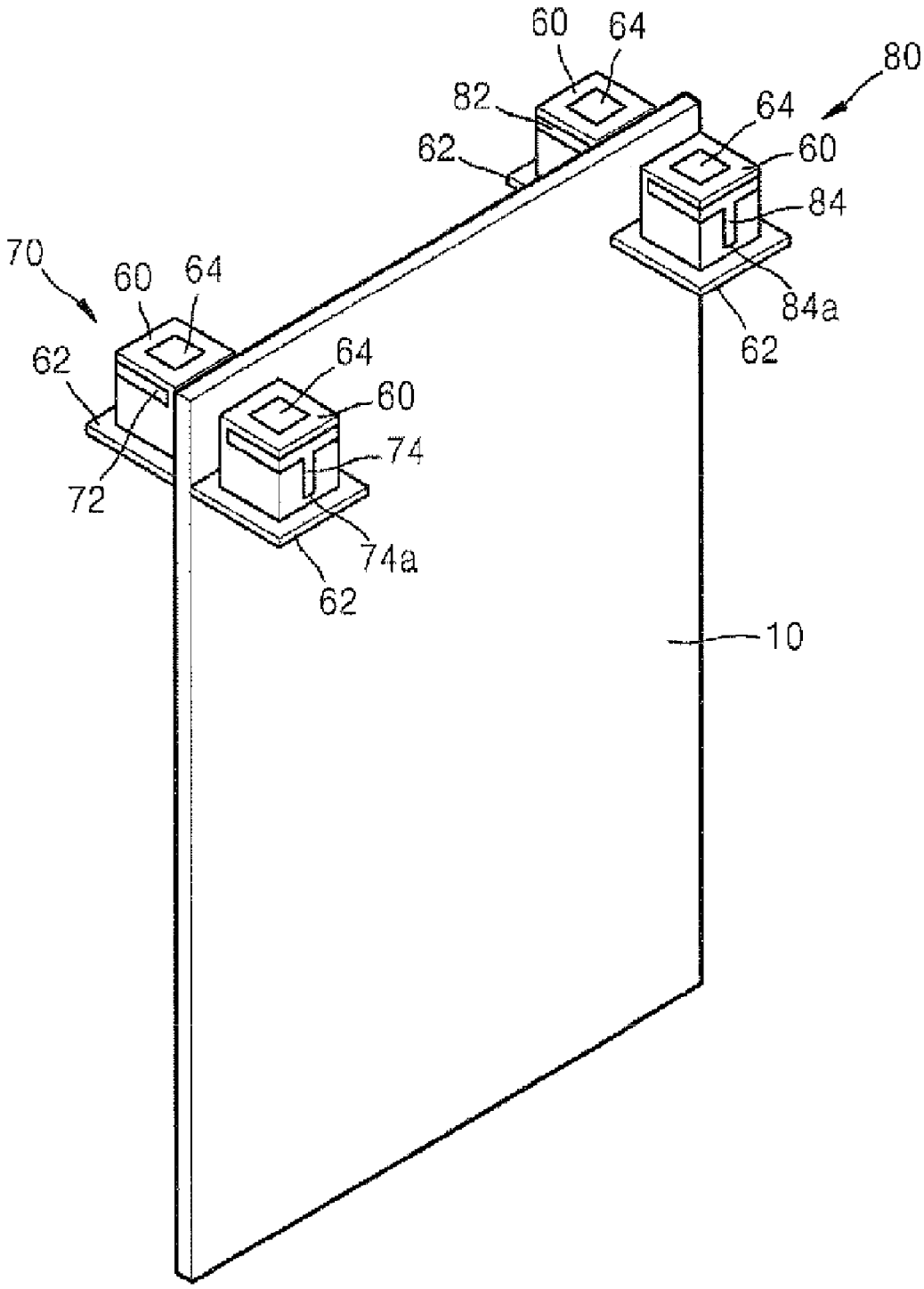
FIG. 9 is a detailed perspective view of the antenna device illustrated in FIG. 8.

FIG. 9 is a perspective view of an antenna device according to another exemplary embodiment of the present invention. Referring to FIG. 9, a cubic antenna 70 includes first cubic antenna elements 72 and 74. Also, a cubic antenna 80 includes second cubic antenna elements 82 and 84. The second cubic antenna 80 substantially has the same structure as the first cubic antenna 70, and thus the first cubic antenna 70 will be mainly described. The first cubic antenna elements 72 and 74, and the second cubic antenna elements 82 and 84 are formed of a metal on surfaces of cubic dielectrics 60. The first cubic antenna elements 72 and 74, and the second cubic antenna elements 82 and 84 may be formed on the surfaces of the dielectrics 60 using a printing method or the like.

The first and second cubic antenna elements 72, 74, 82, and 84 are fed with power from the circuit board 10 through feeders. In FIG. 8, a feeder 74*a* of the first cubic antenna element 74 and a feeder 84*a* of the second cubic antenna element 84 are positioned outside. The dielectrics 60 are installed on boards 62 to be mounted on the circuit board 10. Electrode plates 64 are installed on the surfaces of the dielectrics 60. The boards 62 and the electrode platens are grounded.

In the antenna device according to the present exemplary embodiment, the dielectrics 60 are mounted on the circuit board 10 to integrate the first and second cubic antenna elements 72, 74, 82, and 84 of the first cubic and second antennas 70 and 80 with the dielectrics 60. Alternatively, the first and second cubic antennas 70 and 80 may be installed on the circuit board 10. Thus, the antenna device can be mounted on the circuit board 10 without a complicated work.

In addition, like the antenna device illustrated in FIG. 9, the first and second antennas 20 and 30 may be installed on surfaces of dielectrics to mount the dielectrics on the circuit board 10 in the antenna device illustrated in FIG. 1.

As described above, isotropic pattern waves radiated from the first antenna elements 22 and 24 can be reflected from the circuit board 10 so that radiated electromagnetic waves have directivities, so as to increase communication capacity. Also, the first antenna elements 22 and 24 disposed on the surface of are simultaneously fed with power. Thus, electromagnetic waves radiated from the first antenna elements 22 and 24 can be synthesized with each other to radiate electromagnetic waves in a direction along which the circuit board 10 is disposed, i.e., toward the beam pattern C. Thus, a simple structure can be used to perform communications using an APS system.

As described above, an antenna device according to an exemplary embodiment of the present invention can be mounted in a portable communication terminal. Thus, a simple structure can be used to vary a directivity of an antenna so as to increase communication capacity of the portable communication terminal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An antenna device comprising:

a circuit board;

at least four antenna elements wherein a first two antenna elements are disposed, along one end of the circuit board, symmetrically to each other about both wide surfaces of the circuit board, and a second two antenna elements are disposed, along the other end of the circuit board, symmetrically to each other about the both wide surfaces of the circuit board; and a feeding controller which feeds power selectively to at least one of the four elements, wherein the circuit board is configured to reflect an electromagnetic wave generated from at least one of the four antenna elements.

2. The antenna device of claim 1, wherein the four antenna elements have an identical shape to one another.

3. The antenna device of claim 2, wherein the first two antenna elements and the second two antenna elements are disposed a same distance apart from a central axis of the circuit board in opposite directions.

4. The antenna device of claim 1, wherein the feeding controller feeds the four antenna elements with power so that electromagnetic waves radiated from the first or second two antenna elements are synthesized to have a directivity toward one side or the other side of the circuit board, respectively.

5. The antenna device of claim 1, wherein each of the four antenna elements comprises:

a first element parallel with the wide surfaces of the circuit board;

a feeding terminal through which the power is supplied to each of the four antenna elements; and a second element connecting the feeding terminal to the first element.

6. The antenna device of claim 5, wherein when a wavelength of an electromagnetic wave radiated from each of the four antenna elements is $\lambda$, a horizontal distance, with respect to the wide surfaces of the circuit board, from a side of the circuit board to the first element is less than or equal to $0.15\lambda$.

7. The antenna device of claim 5, wherein when a wavelength of an electromagnetic wave radiated from each of the four antenna elements is $\lambda$, a vertical distance, with respect to the wide surfaces of the circuit board, from the wide surface facing the first element to the first element is not greater than $0.5\lambda$.

8. The antenna device of claim 5, the first element has at least one of a bar-shape and a T-shape.

9. The antenna device of claim 5, wherein the feeding terminal is positioned in a part of the wide surfaces of the circuit board to which a respective antenna element among the four antenna elements is connected.

10. The antenna device of claim 1, wherein each of the four antenna elements is a cubic antenna element formed on a surface of a cubic dielectric.

11. The antenna device of claim 1, wherein the circuit comprises at least two layers, and the electromagnetic wave is reflected at least one of the two layers.

12. The antenna device of claim 1, wherein the circuit board is configured to control a beam pattern of the electromagnetic wave by reflecting the electromagnetic wave generated from the at least one of the four antenna elements.

13. The antenna device of claim 1, wherein the wide surfaces each facing one of the first two antennal elements and one of the second two antenna elements are symmetrical to each other in reflecting electromagnetic waves generated from the first two antenna elements and the second two antenna elements.

14. The antenna device of claim 1, wherein, if the power is fed to only one of the two antenna elements, a first beam pattern having a peak at 90°, perpendicular to the wide surfaces of the circuit board, is generated, wherein, if the power is fed to only the other of the two antenna elements, a second beam pattern having a peak at 270°, which is in an opposite direction to the first beam pattern, is generated, and wherein, if the power is fed to both of the two antenna elements, a third beam pattern having a peak at 180°, which is in a direction toward a side of the circuit board, is generated.

15. The antenna device of claim 14, wherein, if the power is fed to only one of the two antenna elements, a first beam pattern having a peak at 90°, perpendicular to the wide surfaces of the circuit board, is generated, and directivity of the first beam pattern inclines from a direction of 90° to a direction of 180°, wherein, if the power is fed to only the other of the two antenna elements, a second beam pattern having a peak at 270°, which is in an opposite direction to the first beam pattern, is generated, and directivity of the second beam pattern inclines from a direction of 270° to the direction of 180, and wherein, if the power is fed to both of the two antenna elements, a third beam pattern having a peak at 180°, which is in a direction toward a side of the circuit board, is generated.

16. An antenna device comprising:

a circuit board;

at least four antenna elements wherein a first two antenna elements are disposed, along one end of the circuit board, symmetrically to each other about both wide surfaces of the circuit board, and a second two antenna elements are disposed, along the other end of the circuit board, symmetrically to each other about the both wide surfaces of the circuit board; and a feeding controller which feeds power selectively to at least one of the four elements, wherein, if the power is fed to only one of the first two antenna elements or only one of the second two antenna elements, a first beam pattern having a peak at 90°, perpendicular to the wide surfaces of the circuit board, is generated wherein, if the power is fed to only the other of the first two antenna elements or only the other of the second two antenna elements, a second beam pattern having a peak at 270°, which is in an opposite direction to the first beam pattern, is generated, and wherein, if the power is fed to both of the first two antenna elements or both of the second two antenna elements, a third beam pattern having a peak at 180°, which is in a direction toward a side of the circuit board, is generated.

17. An antenna device comprising:

a circuit board;

at least two antenna elements wherein the two antenna elements are disposed symmetrically to each other about both wide surfaces of the circuit board; and a feeding controller which feeds power selectively to at least one of the two antenna elements, wherein the circuit board is configured to reflect an electromagnetic wave generated from at least one of the two antenna elements.

18. The antenna device of claim 17, wherein, if the power is fed to only one of the two antenna elements, a first beam pattern having a peak at 90°, perpendicular to the wide surfaces of the circuit board, is generated, wherein if the power is fed to only the other of the two antenna elements, a second beam pattern having a peak at 270°, which is in an opposite direction to the first beam pattern, is generated, and wherein, if the power is fed to both of the two antenna elements, a third beam pattern having a peak at 180°, which is in a direction toward a side of the circuit board, is generated.

19. The antenna device of claim 17, wherein each of the two antenna elements comprises:

a first element parallel with the wide surfaces of the circuit board and having a bar shape;

a feeding terminal through which the power is supplied to each of the four antenna elements; and a second element connecting the feeding terminal to the first element.

20. The antenna device of claim 19, wherein when a wavelength of an electromagnetic wave radiated from each of the two antenna elements is $\lambda$, a horizontal distance, with respect to the wide surfaces of the circuit board, from a side of the circuit board to the first element is less than or equal to $0.15\lambda$.

21. The antenna device of claim 19, wherein when a wavelength of an electromagnetic wave radiated from each of the two antenna elements is $\lambda$, a vertical distance, with respect to the wide surfaces of the circuit board, from the wide surface facing the first element to the first element is not greater than $0.5\lambda$.

22. The antenna device of claim 17, wherein the circuit board is configured to control a beam pattern of the electromagnetic wave by reflecting the electromagnetic wave generated from the at least one of the four antenna elements.

23. The antenna device of claim 17, wherein the wide surfaces each facing one of the first two antennal elements and one of the second two antenna elements are symmetrical to each other in reflecting electromagnetic waves generated from the first two antenna elements and the second two antenna elements.

24. The antenna device of claim 18, wherein, if the power is fed to only one of the two antenna elements, a first beam pattern having a peak at 90°, perpendicular to the wide surfaces of the circuit board, is generated, and directivity of the first beam pattern inclines from a direction of 90° to a direction of 180°, wherein, if the power is fed to only the other of the two antenna elements, a second beam pattern having a peak at 270°, which is in an opposite direction to the first beam pattern, is generated, and directivity of the second beam pattern inclines from a direction of 270° to the direction of 180, and wherein, if the power is fed to both of the two antenna elements, a third beam pattern having a peak at 180°, which is in a direction toward a side of the circuit board, is generated.

* * * * *